US010718518B2

(12) United States Patent
Eadie et al.

(10) Patent No.: US 10,718,518 B2
(45) Date of Patent: Jul. 21, 2020

(54) SYSTEMS AND METHODS FOR AVOIDING HARMONIC MODES OF GAS BURNERS

(71) Applicant: Brunswick Corporation, Mettawa, IL (US)

(72) Inventors: Philip Eadie, Bangor (IE); Stuart C. Black, Ballyclare (IE)

(73) Assignee: Brunswick Corporation, Mettawa, IL (US)

( * ) Notice: Subject to any disclaimer, the term of this patent is extended or adjusted under 35 U.S.C. 154(b) by 253 days.

(21) Appl. No.: 15/827,448

(22) Filed: Nov. 30, 2017

(65) Prior Publication Data

US 2019/0162408 A1 May 30, 2019

(51) Int. Cl.
*F23N 5/12* (2006.01)
*F23N 5/18* (2006.01)
(Continued)

(52) U.S. Cl.
CPC ..... *F23N 5/123* (2013.01); *F23D 14/02* (2013.01); *F23D 14/26* (2013.01); *F23D 14/36* (2013.01);
(Continued)

(58) Field of Classification Search
CPC ..... F23N 5/123; F23N 3/082; F23N 2233/08; F23N 5/24; F23N 5/187; F23N 2241/14; F23N 2235/24; F23N 2235/18; F23N 2235/16; F23N 2235/14; F23N 2900/05005; F23N 2229/16; F23N 2229/12;
(Continued)

(56) References Cited

U.S. PATENT DOCUMENTS 4,086,048 A * 4/1978 Carlson ..... F23N 5/123 361/256
4,712,996 A 12/1987 Adams et al.
(Continued)

FOREIGN PATENT DOCUMENTS

DE 3604314 8/1987
DE 10220774 11/2003
(Continued)

OTHER PUBLICATIONS

Extended European Search Report, EP Patent Application No. 18208791, dated Jul. 18, 2019.
(Continued)

*Primary Examiner* — Grant Moubry
*Assistant Examiner* — Rabeeul I Zuberi
(74) *Attorney, Agent, or Firm* — Andrus Intellectual Property Law, LLP

(57) ABSTRACT

A gas burner system has a gas burner with a conduit through which an air-gas mixture is conducted; a variable-speed forced-air device that forces air through the conduit; a control valve that controls a supply of gas for mixture with the air to thereby form the air-gas mixture; and an electrode configured to ignite the air-gas mixture so as to produce a flame. The electrode is further configured to measure a flame ionization current associated with the flame. A controller is configured to actively control the variable-speed forced-air device based on the flame ionization current measured by the electrode so as to automatically avoid a flame harmonic mode of the gas burner. Corresponding methods are provided.

12 Claims, 9 Drawing Sheets

(51) Int. Cl.

| | |
|---|---|
| ***F23M 20/00*** | (2014.01) |
| ***F23N 5/24*** | (2006.01) |
| ***F23D 14/26*** | (2006.01) |
| ***F23D 14/02*** | (2006.01) |
| ***F23D 14/36*** | (2006.01) |
| ***F23L 5/02*** | (2006.01) |
| ***F23N 3/08*** | (2006.01) |
| ***F23D 14/62*** | (2006.01) |

(52) U.S. Cl.
CPC ..... *F23D 14/62* (2013.01); *F23L 5/02* (2013.01); *F23M 20/005* (2015.01); *F23N 3/082* (2013.01); *F23N 5/187* (2013.01); *F23N 5/24* (2013.01); *F23D 2203/103* (2013.01); *F23D 2203/106* (2013.01); *F23D 2203/1023* (2013.01); *F23K 2900/05002* (2013.01); *F23N 2229/12* (2020.01); *F23N 2229/16* (2020.01); *F23N 2233/08* (2020.01); *F23N 2235/14* (2020.01); *F23N 2235/16* (2020.01); *F23N 2235/18* (2020.01); *F23N 2235/24* (2020.01); *F23N 2237/26* (2020.01); *F23N 2241/14* (2020.01); *F23N 2900/05005* (2013.01)

(58) Field of Classification Search
CPC ..... F23N 2237/26; F23L 5/02; F23D 14/36; F23D 14/02; F23D 14/26; F23D 2203/1023; F23D 2203/106; F23D 2203/103; F23M 20/005; F23K 2900/05002
USPC ..... 251/129.06, 129.08; 137/891, 883
See application file for complete search history.

(56) References Cited

U.S. PATENT DOCUMENTS

| | | | | |
|---|---|---|---|---|
| 5,062,790 | A | 11/1991 | Loberger et al. | |
| 5,335,841 | A * | 8/1994 | Yamanashi | C25D 5/10 228/149 |
| 5,355,841 | A | 10/1994 | Moore, Jr. et al. | |
| 5,682,826 | A * | 11/1997 | Hollenbeck | F23N 1/062 110/147 |
| 5,865,616 | A | 2/1999 | George | |
| 5,984,664 | A | 11/1999 | Sutton | |
| 7,131,462 | B1 | 11/2006 | Chen | |
| 8,075,304 | B2 | 12/2011 | Cox et al. | |
| 2002/0086254 | A1 | 7/2002 | Chen | |
| 2006/0051718 | A1 * | 3/2006 | Kamal | F23D 14/06 431/354 |
| 2006/0199123 | A1 * | 9/2006 | Seguin | F23N 5/082 431/75 |
| 2009/0211540 | A1 * | 8/2009 | Yin | F24H 1/205 122/18.3 |
| 2010/0112500 | A1 * | 5/2010 | Maiello | F23N 1/022 431/76 |
| 2015/0081086 | A1 | 3/2015 | Hallowell et al. | |
| 2015/0276221 | A1 * | 10/2015 | Abate | F23N 1/002 431/2 |
| 2016/0047547 | A1 * | 2/2016 | Barels | F24H 9/2035 122/14.2 |
| 2017/0030581 | A1 * | 2/2017 | Li | F23D 14/14 |

FOREIGN PATENT DOCUMENTS

| | | |
|---|---|---|
| EP | 2871415 | 5/2015 |
| EP | 3124866 | 2/2017 |
| WO | 2010/094673 | 8/2010 |

OTHER PUBLICATIONS

Partial European Search Report, EP Patent Application No. 18208791, dated Mar. 28, 2019.

* cited by examiner

| POWER SETTING | OUTLET 1 | OUTLET 2 |
|---|---|---|
| OFF | CLOSED | CLOSED |
| LOW | OPEN | CLOSED |
| MEDIUM | CLOSED | OPEN |
| HIGH | OPEN | OPEN |

SYSTEMS AND METHODS FOR AVOIDING HARMONIC MODES OF GAS BURNERS

FIELD

The present disclosure relates to gas burners, for example gas burners that fully pre-mix liquid propane gas and air for combustion. The present disclosure further relates to systems and methods for operating such fully pre-mix gas burners.

BACKGROUND

The following US patents and patent publication are incorporated herein by reference.

U.S. Pat. No. 8,075,304 discloses a power burner system for use with a heating appliance. The power burner system includes a burner tube, a gas valve for providing gas to the burner tube, and a variable-speed combustion air blower for mixing air with the gas provided to the burner tube. The burner system further includes a controller in communication with the gas valve and the combustion air blower. The controller may also be in communication with various other devices of an appliance, such as a variable-speed air-circulating fan, a variable-speed exhaust fan, or various sensors associated with the heating appliance. The controller modulates the gas valve and the combustion air blower to maintain substantially stoichiometric conditions of the gas and air provided to the burner tube and as a function of signals from at least one of the devices. In one embodiment, the burner system may be used in a conveyor oven.

U.S. Patent Application Publication No. 2016/0047547 discloses a water heating device, comprising a burner and a flame current measuring device for measuring a flame current. The measuring device comprises two electrodes and a voltage source. Each of the poles of the voltage source is connected to one of the electrodes. The water heating device further comprises a heat exchanger which is electrically insulated relative to the burner. The burner and the heat exchanger form the electrodes of the flame current measuring device. The heat exchanger functioning as electrode can be earthed. The measured flame current can be used to determine the excess air factor of the combustion. The water heating device can further comprise an air/fuel controller for controlling the air/fuel ratio, wherein the air/fuel controller uses the determined excess air factor to control the air/fuel ratio.

U.S. Pat. No. 5,984,664 discloses an apparatus that provides an air/fuel mixture to a fully premixed burner and a fuel line that provides fuel to the burner. A fan supplies air at a variable flow rate to the fuel to form the mixture. A sensor senses aeration of the fuel combustion products. A controller controls the air flow rate in dependence upon the aeration sensed and in such a way that the air flow rate is sufficient to maintain the aeration at or close to a predetermined value. The controller maintains the air flow rate at one of a number of differing predetermined values which are in the form of a geometric series characterized by a constant value of the ratio between successive values.

U.S. Pat. No. 4,712,996 discloses a gas burner control system for controlling operation of a furnace. A blower is fluidically connected to the combustion chamber of the furnace. The system utilizes a mass flow sensor for preventing or discontinuing burner operation in the event of a blower failure or a predetermined degree of blockage in the fluid flow path controlled by the blower. The mass flow sensor includes a circuit which enables use of unmatched sensors, enables establishing of a desired value of temperature difference between sensors, enables establishing a temperature difference that is not constant so as to compensate for different ambient air densities, and enables compensating for voltage variations at different ambient air temperatures.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A gas burner system according to the present disclosure has a gas burner with a conduit through which an air-gas mixture is conducted; a variable-speed forced-air device that forces air through the conduit; a control valve that controls a supply of gas for mixture with the air to thereby form the air-gas mixture; and an electrode configured to ignite the air-gas mixture so as to produce a flame. The electrode is further configured to measure a flame ionization current associated with the flame. A controller is configured to actively control (e.g. vary the speed of) the variable-speed forced-air device based on the flame ionization current measured by the electrode in a manner that automatically avoids a flame harmonic mode of the gas burner. Corresponding methods are herein disclosed.

DETAILED DESCRIPTION OF THE DRAWINGS

Typical premix liquid gas propane (LPG) burners have five modes of combustion including (1) harmonic, (2) rich instability, (3) lean instability, (4) silent and (5) pulsating. In the harmonic mode, the gas burner tends to produce sound having a frequency of 1400-1800 hertz and amplitude of greater than 55 decibels. The present inventors have found that this sound, sometimes referred to as "whistling", can be a significant problem, for example in the vehicle heating market, because the user often operates the gas burner in the middle of the night when the sound is particularly disturbing. Based on this realization, the present inventors conducted research and development and invented the presently disclosed systems and methods, which are configured to operate the gas burner in a way that advantageously avoids the above-described harmonic mode.

Figure 1:
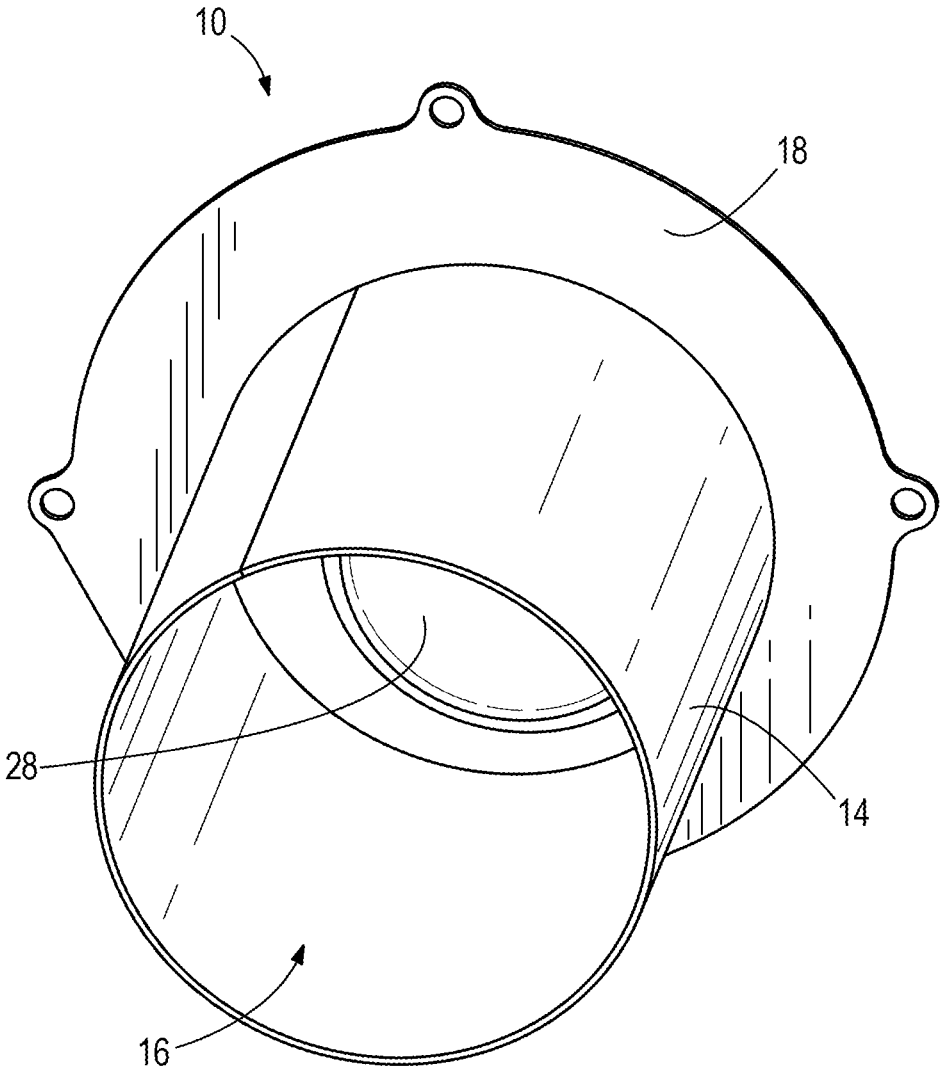
FIG. 1 is a perspective view of an exemplary gas burner according to the present disclosure.
Figure 2:
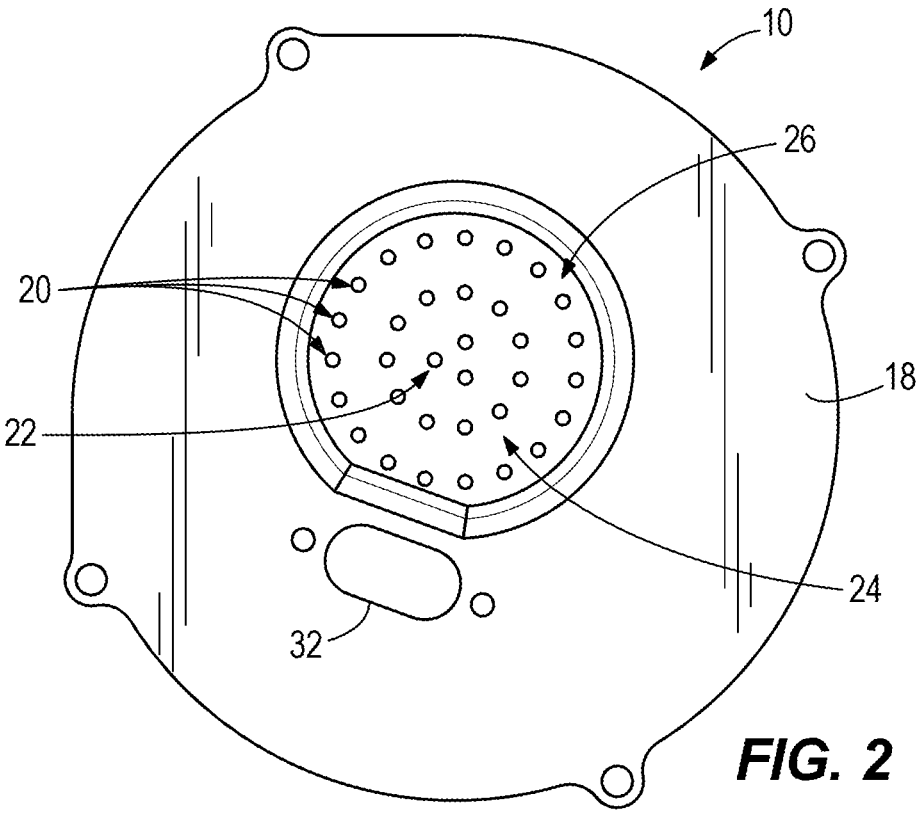
FIG. 2 is an end view of the gas burner.
Figure 3:
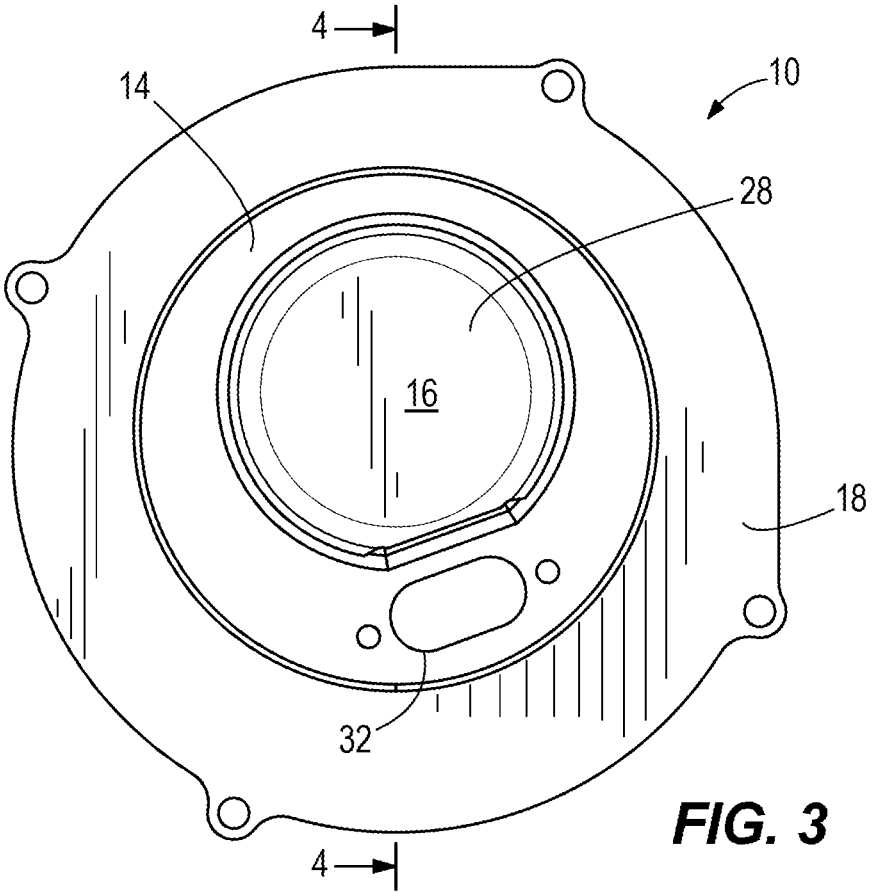
FIG. 3 is an opposite end view of the gas burner.

FIGS. 1-4 depict an exemplary gas burner 10 according to the present disclosure. The gas burner 10 has an elongated metal flame tube 14 that defines a conduit 16 into which a fully pre-mixed air-gas mixture is conveyed for combustion. A metal burner deck 18 is disposed on one end of the flame tube 14. The burner deck 18 has a plurality of aeration holes 20 through which the air-gas mixture is caused to flow, as will be further explained herein below. In the illustrated example, the plurality of aeration holes 20 includes a total of thirty-three aeration holes, each hole having a diameter of between 1.9 and 2.1 millimeters. A first group of three holes 22 are in the center of the plurality and are spaced apart equidistant from each other and surrounded by a second group of eleven holes 24 that are spaced equidistant from each other. The second group of eleven holes 24 is surrounded by a third group of nineteen holes 26 that are also spaced equidistant from each other. As shown in FIG. 2, the second and third groups of holes 24, 26 form two concentric circles around the first group of three holes 22. Together, the plurality of aeration holes 20 provides an open area of between 18.7%-22.8% of the portion of the burner deck 18 inside the conduit 16. No secondary air is introduced into the gas burner 10.

Figure 4:
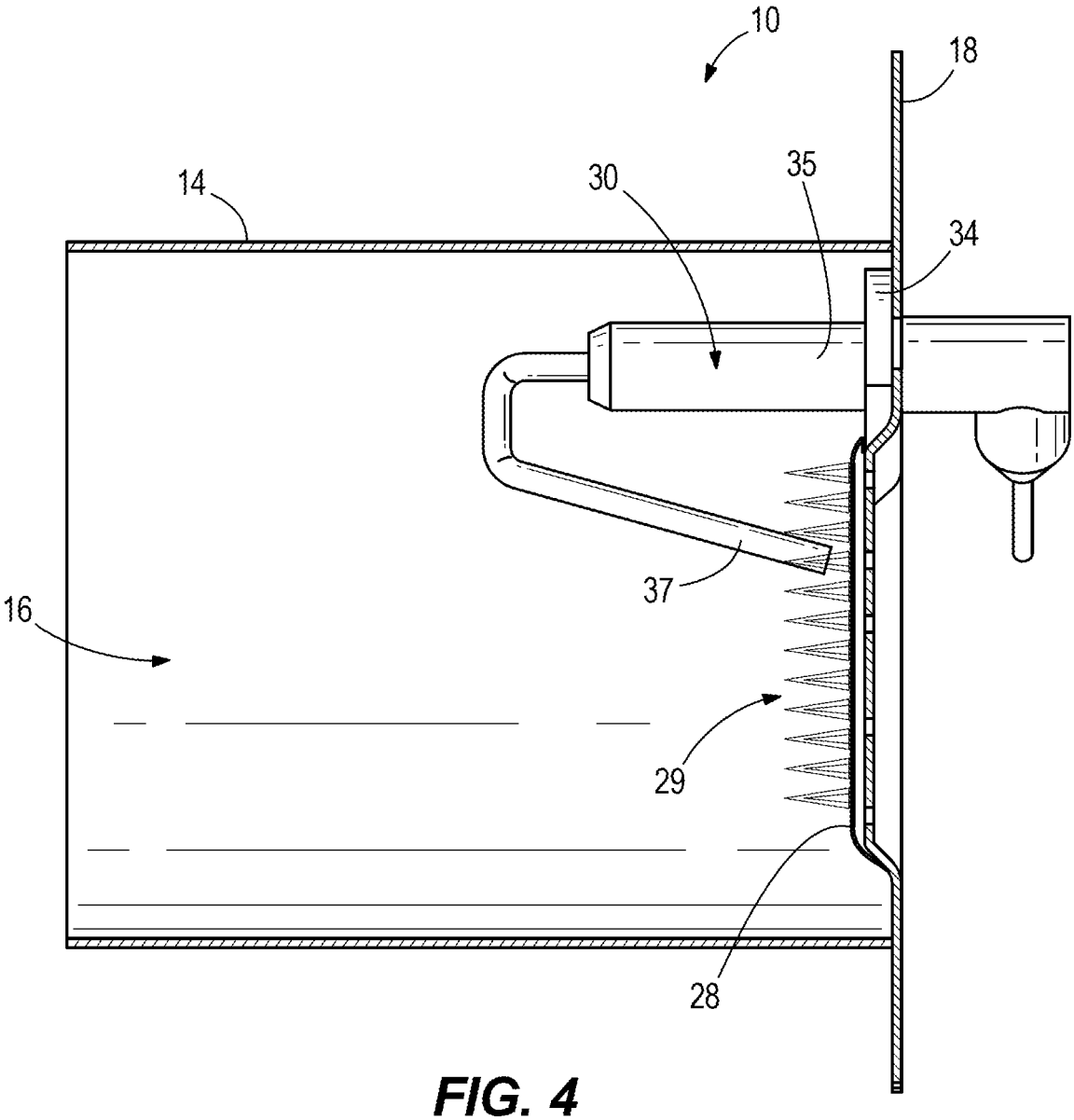
FIG. 4 is a sectional view of the gas burner, showing a flame and an electrode inside the gas burner.

A metal burner skin 28 is located in the flame tube 14 and is attached to the inside surface of the burner deck 18 so that the burner skin 28 covers the plurality of aeration holes 20. In the illustrated example, the burner skin 28 is made of woven metal matting, however the type and configuration of burner skin 28 can vary from what is shown. As shown in FIG. 4, the burner skin 28 is configured to distribute the air-gas mixture from the plurality of aeration holes 20 and thus facilitate a consistent and evenly distributed burner flame 29 inside the flame tube 14.

An ignition and flame sensing electrode 30 is disposed in the flame tube 14, proximate to the burner skin 28. The electrode 30 extends through a through-bore 32 in the burner deck 18 and is fastened to the burner deck 18 via a connecting flange 34. The type of electrode 30 and the manner in which the electrode 30 is coupled to the gas burner 10 can vary from what is shown. The electrode 30 can be a conventional item, for example a Rauschert Electrode, Part No. P-17-0044-05. The electrode 30 has a ceramic body 35 and an electrode tip 37 that is oriented towards the burner skin 28. The electrode 30 is configured to ignite the air-gas mixture in a conventional manner, as the air-gas mixture passes through the conduit 16 via the plurality of aeration holes 20. The resulting burner flame 29 is thereafter maintained as the air-gas mixture flows through the burner skin 28.

The electrode 30 is further configured to measure the flame ionization current associated with the burner flame 29. Specifically, the electrode tip 37 is placed at the location of the burner flame 29 with a distance of 2.5+/−0.5 mm between the electrode tip 37 and the burner skin 28. A voltage of 275+/−15V is applied across the electrode 30 and burner skin 28, with the electrode 30 being positive and the burner skin 28 being negative. The chemical reactions that occur during combustion create charged particles, which are proportional to the air/fuel ratio of a given fuel. The potential difference across the gas burner 10 can be used to measure and quantify this. The electrode 30 is configured to measure the differential and, based on the differential, determine the flame ionization current, as is conventional and known in the art. The flame ionization current is proportional the actual fuel-to-air equivalence ratio for a given mixture.

Figure 5:
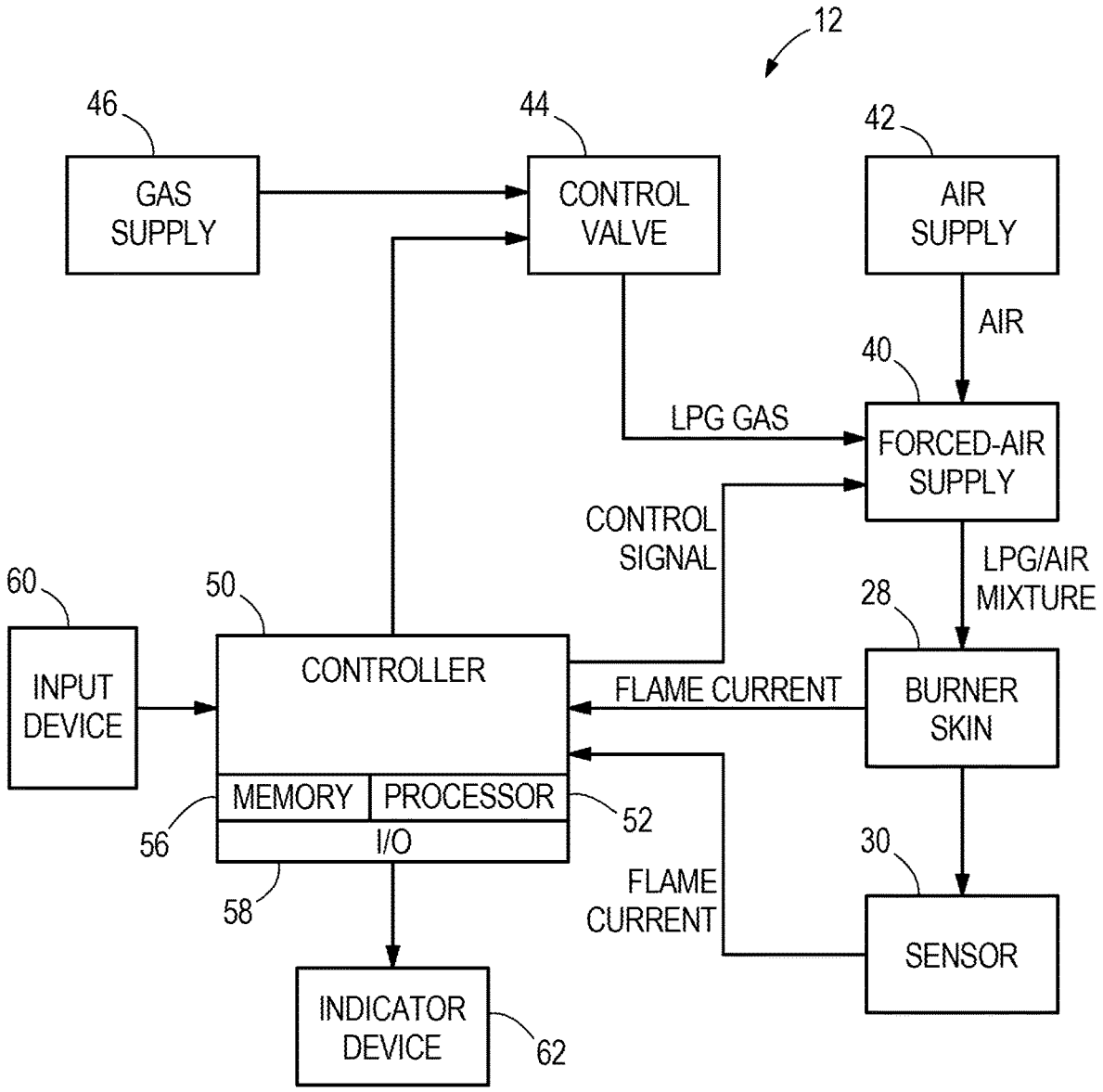
FIG. 5 is a schematic view of a gas burner system according to the present disclosure.

Referring now to FIG. 5, the gas burner 10 is part of a gas burner system 12. The gas burner system 12 includes a variable-speed forced-air device 40, which for example can be a fan and/or a blower having a speed that can be varied. One example is a fan that is powered by a brushless DC motor. The gas burner system 12 also includes a supply of a gas 46 that is combustable, such as liquid propane gas, and a control valve 44 that is specially configured to control the supply of gas 46 to the gas burner 10. As will be further described herein below with reference to FIGS. 7 and 8, the control valve 44 is a solenoid that is movable into a fully closed position preventing flow of gas and alternately into one of several wide open positions allowing flow of gas. In use, the variable-speed forced-air device 40 is configured to force a mixture of air from the supply of ambient air 42 and combustible gas from the supply of gas 46 through the plurality of aeration holes 20 and into the conduit 16. It will thus be understood by those having ordinary skill in the art that the gas burner system 12 is a "fully premix" gas burner system in which all the gas (e.g. LPG) is introduced via the control valve 44 and all air introduced into the conduit 16 is introduced via the variable-speed forced-air device 40. The air and gas are mixed together to form the above-mentioned air-gas mixture, which is ignited by the electrode 30 in the conduit 16.

The gas burner system 12 also includes a computer controller 50. As explained herein below, the controller 50 is specially programmed to actively control the speed of the forced-air device 40 based on the flame ionization current measured by the electrode 30. According to the programming structure and methods of the present invention, the controller 50 is programmed to avoid the flame harmonic mode of the gas burner 10. The controller 50 includes a computer processor 52, computer software, a memory 56 (i.e. computer storage), and one or more conventional computer input/output (interface) devices 58. The processor 52 loads and executes the software from the memory 56. Executing the software controls operation of the system 12 as described in further detail herein below. The processor 52 can include a microprocessor and/or other circuitry that receives and executes software from memory 56. The processor 52 can be implemented within a single device, but it can alternately be distributed across multiple processing devices and/or subsystems that cooperate in executing program instructions. Examples include general purpose central processing units, application specific processors, and logic devices, as well as any other processing device, combinations of processing devices, and/or variations thereof. The controller 50 can be located anywhere with respect to the gas burner 10 and can communicate with various components of the gas burner system 12 via the wired and/or wireless links shown schematically in the drawings. The memory 56 can include any storage media that is readable by the processor 52 and capable of storing the software. The memory 56 can include volatile and/or nonvolatile, removable and/or non-removable media implemented in any method or technology for storage of information, such as computer readable instructions, data structures, program modules, or other data. The memory 56 can be implemented as a single storage device but may also be implemented across multiple storage devices or subsystems.

The computer input/output device 58 can include any one of a variety of conventional computer input/output interfaces for receiving electrical signals for input to the processor 52 and for sending electrical signals from the processor 52 to various components of the gas burner system 12. The controller 50, via the noted input/output device 58, communicates with the electrode 30, forced-air device 40 and control valve 44 to control operation of the gas burner system 12. As explained further herein below, the controller 50 is capable of monitoring and controlling operational characteristics of the gas burner system 12 by sending and/or receiving control signals via one or more of the links. Although the links are each shown as a single link, the term "link" can encompass one or a plurality of links that are each connected to one or more of the components of the gas burner system 12. As mentioned herein above, these can be wired or wireless links.

The gas burner system 12 further includes one or more operator input device 60 for inputting operator commands to the controller 50. The operator input device 60 can include a power setting selector, which can include for example a push button, switch, touch screen, or other device for inputting an instruction signal to the controller 50 from the operator of the of system 12. Such operator input devices for inputting operator commands to a controller are well known in the art and therefore for brevity are not further herein described.

The gas burner system 12 further includes one or more indicator devices 62, which can include a visual display screen, a light, an audio speaker, or any other device for providing feedback to the operator of the system.

Figure 8:
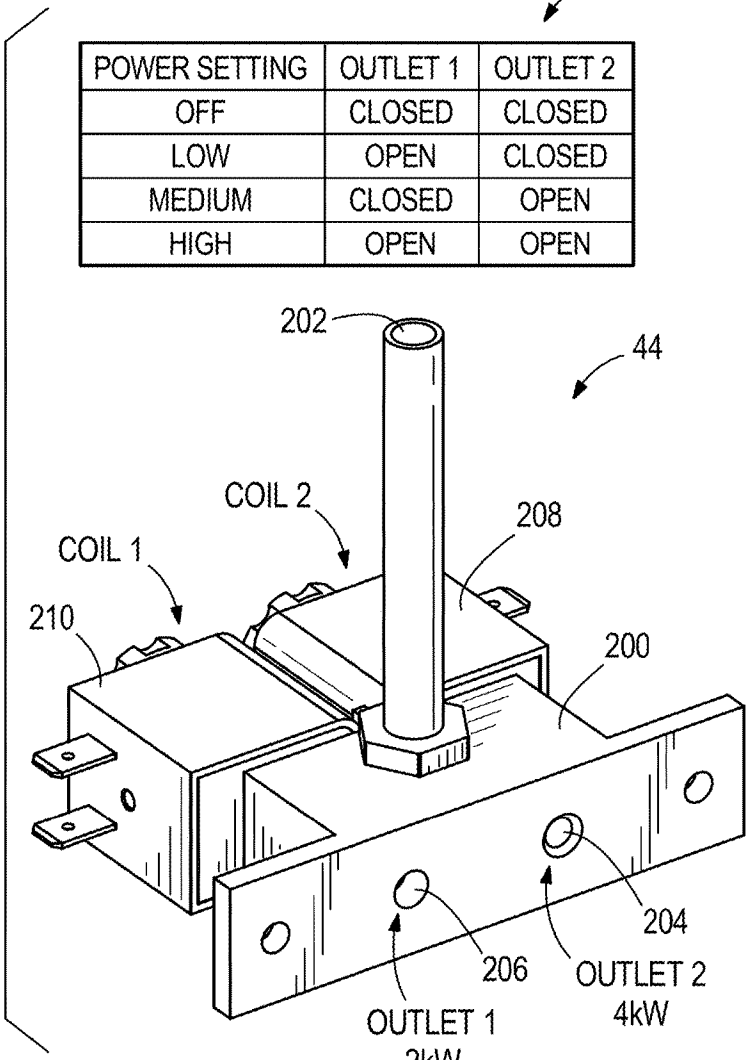
FIGS. 7 and 8 depict one example of a control valve for controlling a supply of gas to the gas burner.
Figure 7:
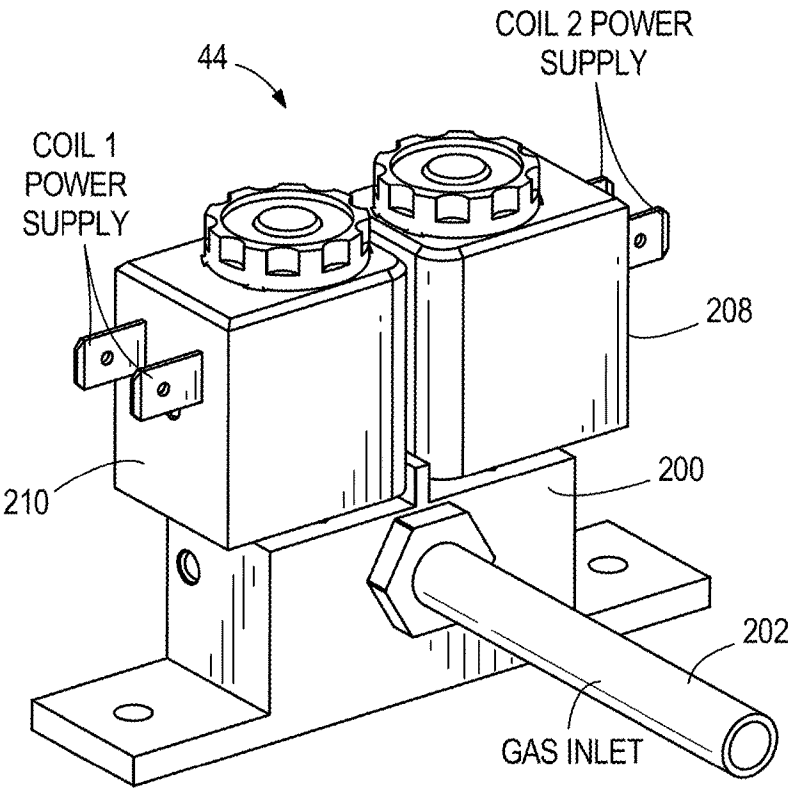

The supply of gas 46 is controlled by the control valve 44, and as such the burner system 12 has discrete settings for heat input. An example of a suitable control valve 44 is shown in FIGS. 7 and 8. In this non-limiting example, the control valve 44 has a valve body 200 with an inlet port 202 that receives a combustible gas from the supply of gas 46 and a pair of outlet ports 204, 206 which, in parallel, discharge the gas for combustion in the gas burner 10. A pair of conventional solenoid coils 208, 210 are connected to the valve body 200 and configured to independently control discharge of the gas via the pair of outlet ports 204, 206, respectively. That is, each solenoid coil 208, 210 is connected to a respective one of the outlet ports 204, 206 and configured to fully open and fully close to thereby control the flow of gas therethrough. Each of the solenoid coils 208, 210 is electrically coupled to a power supply, as shown, and configured such that the controller 50 can selectively cause the solenoid coils 208, 210 to independently open and/or shut.

The control valve 44 facilitates four discrete power settings, see Table 213 in FIG. 8. The power settings include "off" wherein both of the solenoid coils 208, 210 are fully closed, "low" wherein the solenoid coil 208 is fully open and the solenoid coil 210 is fully closed, "medium" wherein the solenoid coil 208 is fully closed and the solenoid coil 210 is fully open, and "high" wherein both of the solenoid coils 208, 210 are fully open.

In a non-limiting example, the forced-air device 40 is a fan and the following discrete power settings are available. Each power setting has a minimum fan speed saved in the memory 56 of the controller 50.

| Power Setting | Gross Heat Input (kW) | Min Fan Speed (rpm) |
|---|---|---|
| Off | 0 | 0 |
| Low | 1.35 | 1500 |
| Medium | 4.7 | 3600 |
| High | 6 | 4800 |

Through research and experimentation, the present inventors have determined that to avoid the harmonic mode, it is necessary for each discrete power setting to maintain certain minimum air-gas mixture velocities produced by the forced-air device 40. With the illustrated burner configuration, the present inventors have determined, through experimentation, that it is necessary to maintain a Reynolds number greater than 1000 and an equivalence ratio of greater than about 1.2 to avoid the above-described harmonic mode. As described above, the equivalence ratio can be determined by the controller 50 based on the flame ionization current. For this example, the following flame strength set points are stored in the memory 56 of the controller 50 during setup of the gas burner system 12:

| Power Setting | Flame Strength Set Point (μA) |
|---|---|
| Off | 0 |
| Low | 2.5 |
| Medium | 1.8 |
| High | 1.2 |

Referring now to FIG. 5, the controller 50 is configured to receive an input (e.g. a power setting selection) from an operator via the operator input device 60. In response to the input, the controller 50 is further configured to send a control signal to the forced-air device 40 to thereby modify (turn on or increase) the speed of the forced-air device 40. The controller 50 is further configured to send a control signal to the control valve 44 to cause one or both of the solenoid coils 208, 210 in the control valve 44 to open and thus provide a supply of gas. The controller 50 is further configured to cause the electrode 30 to spark and thus create the burner flame, and then monitor the flame current from the burner skin 28 and electrode 30, thus enabling calculation of the above-described flame ionization current, in real time. Based on the flame ionization current, the controller 50 is configured to further control the speed of the forced-air device 40 (via for example the motor for the forced-air device 40) to maintain the necessary equivalence ratio to avoid the harmonic mode and/or send a control signal to the indicator device 62, for example if the equivalence ratio cannot be achieved in the current setting without reducing the fan speed below the stored minimum value. Each of the above functions are carried out via the illustrated wired or wireless links, which together can be considered to be a computer network to which the various devices are connected.

Figure 6:
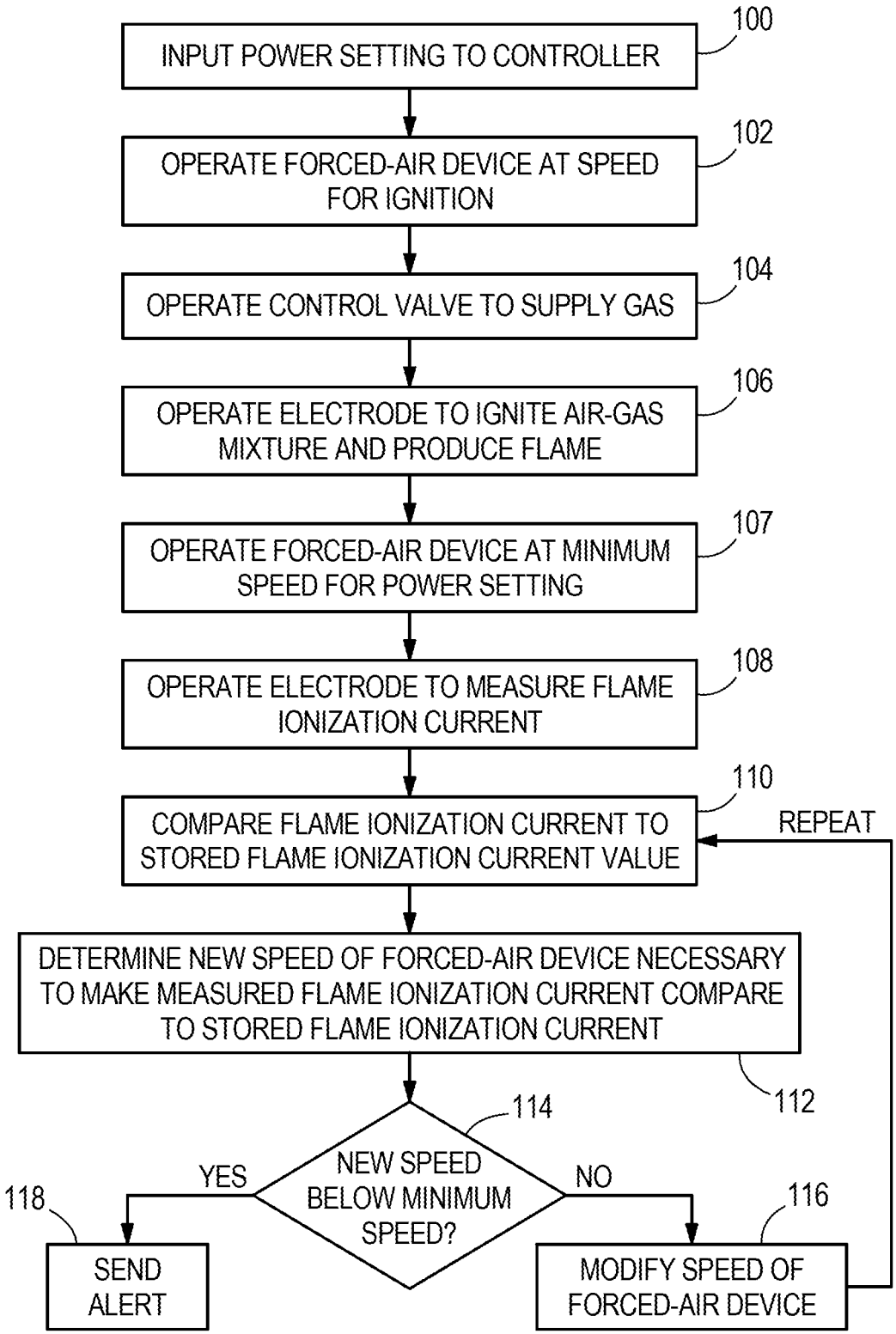
FIG. 6 is a flow chart for an exemplary method according to the present disclosure.

FIG. 6 depicts a non-limiting exemplary method according to the present disclosure. At step 100, the operator inputs a power setting to the controller 50 via the operator input device 60. The operator can select one of the three power settings (Low, Medium, High) shown in the above table. At step 102, the controller 50 operates the forced-air device 40 at an initial speed stored in the memory 56 that is suitable for ignition of the gas burner 10. At step 104, the controller 50 causes the control valve 44 to move into the open position for the selected power setting (see table 213 in FIG. 8), thus providing gas from the supply of gas mixed with air from the supply of air via the forced-air device 40. At step 106, the controller 50 operates the electrode 30 to ignite the air-gas mixture and produce the burner flame 29.

At step 107, the controller operates the forced-air device 40 at the minimum speed for the selected power setting. At step 108, controller 50 determines the actual flame ionization current via the electric current applied to the electrode 30 and burner skin 28 (as described above). As step 110, the controller 50 compares the measured flame ionization current to the target flame ionization current for the selected particular power setting, which is saved in the memory 56. Based on this comparison, at step 112, the controller 50 determines whether an increase or decrease in speed of the forced-air device 40 is needed to make the actual flame ionization current equal to the target flame ionization current. If a reduction in speed of the forced-air device 40 is required, at step 114, the controller 50 first ensures the reduced speed is not below the minimum speed for that particular power setting. If it is not, at step 116, the controller 50 modifies the speed of the forced-air device 40, accordingly. If it is, at step 118, then instead of reducing the speed, the controller 50 controls the indicator device 62 to alert the operator that the system 12 has a malfunction.

Thus, by characterizing the system in a way that bounds (limits) the minimum speed of the forced-air device 40, the controller 50 advantageously will automatically operate the gas burner system 12 in a way that avoids flame harmonics. This advantageously results in a significant reduction or total avoidance of undesirable noise that would otherwise occur in the harmonic mode. The exemplary embodiment disclosed herein also advantageously balances emission compliance and optimizes noise considerations with the use of a single electrode. This is contrasted with conventional systems, which simply focus on reducing emissions by using multiple electrodes.

Figure 9:
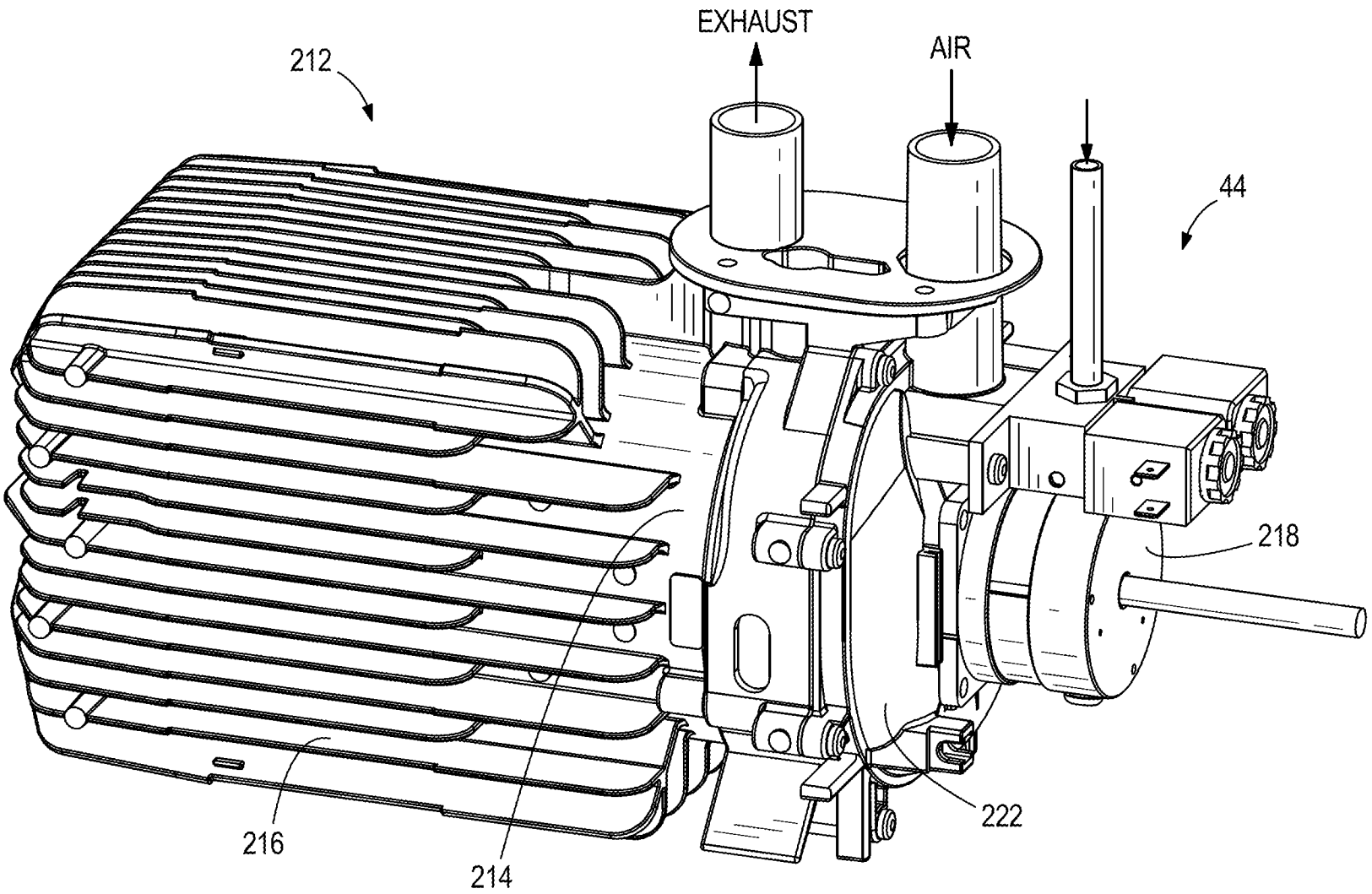
FIG. 9 is a perspective view of portions of an exemplary gas burner system having a heat exchanger according to the present disclosure.
Figure 10:
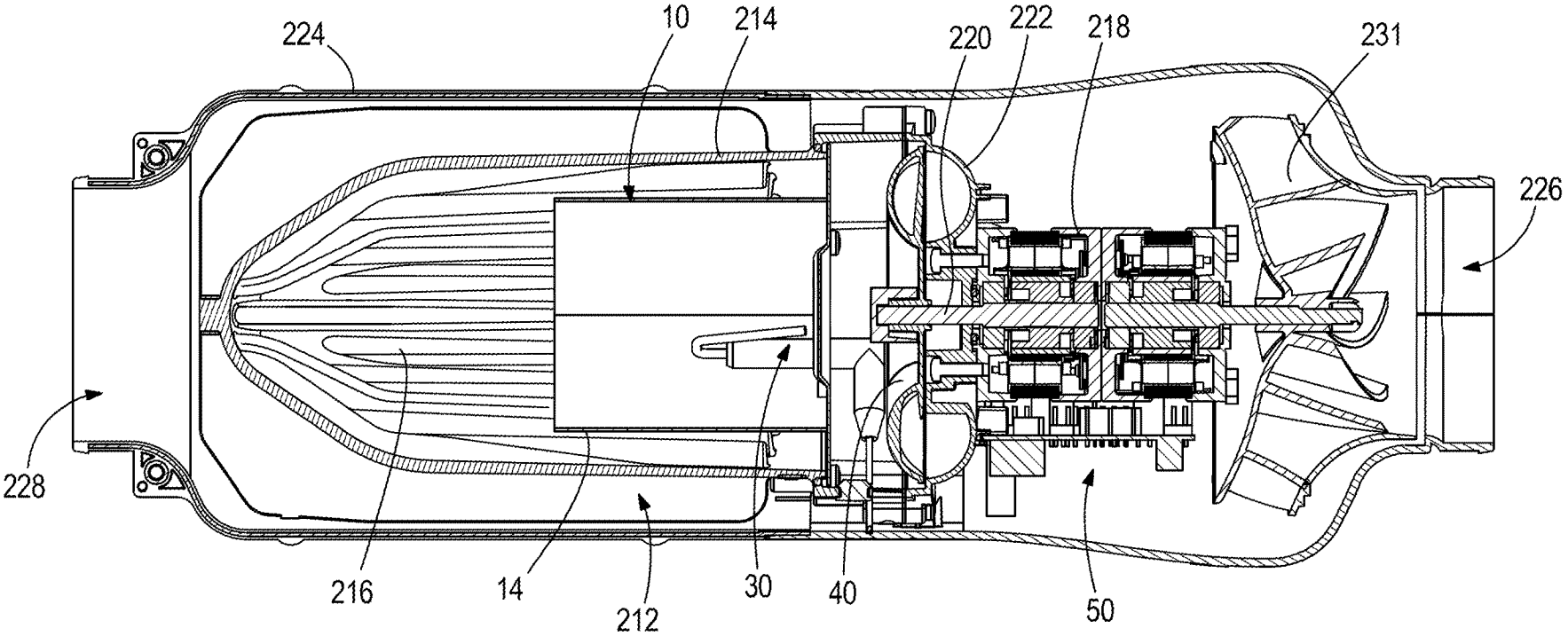
FIG. 10 is a sectional view of the example shown in FIG. 9 including a housing surrounding the heat exchanger and fan.

FIGS. 9 and 10 depict the gas burner system 12 incorporated with a heat exchanger 212 having a cast aluminum body 214 with a plurality of heat radiating fins 216. The gas burner 10 extends into the body 214 and is coupled to the heat exchanger 212 so that the heat generated by the gas burner 10 heats the heat exchanger 212. In this example, the variable-speed forced-air device 40 is a fan that is powered by a motor 218. The motor 218 has an output shaft 220 that extends through a combustion chamber end cap 222 into engagement with the fan 40. Operation of the motor 218 thus causes rotation of the fan 40 and forces air through the gas burner 10 as will be described further herein below.

Referring to FIG. 10, a plastic housing 224 houses the heat exchanger 212 and gas burner 10, as well as the fan 40 and associated motor 218. The housing 224 has an upstream cool air inlet 226 that receives relatively cool air and downstream warm air outlet 228 that discharges relatively warm air. A second fan 231 is disposed in the housing 224 and configured to draw ambient air into the cool air inlet 226 and force it across the heat exchanger 212, and out of the downstream warm air outlet 228. As the air travels across the heat exchanger 212, as will be understood by those having ordinary skill in the art, the air exchanges heat with the heat exchanger and is warmed prior to discharge via the warm air outlet 228.

Figure 11:
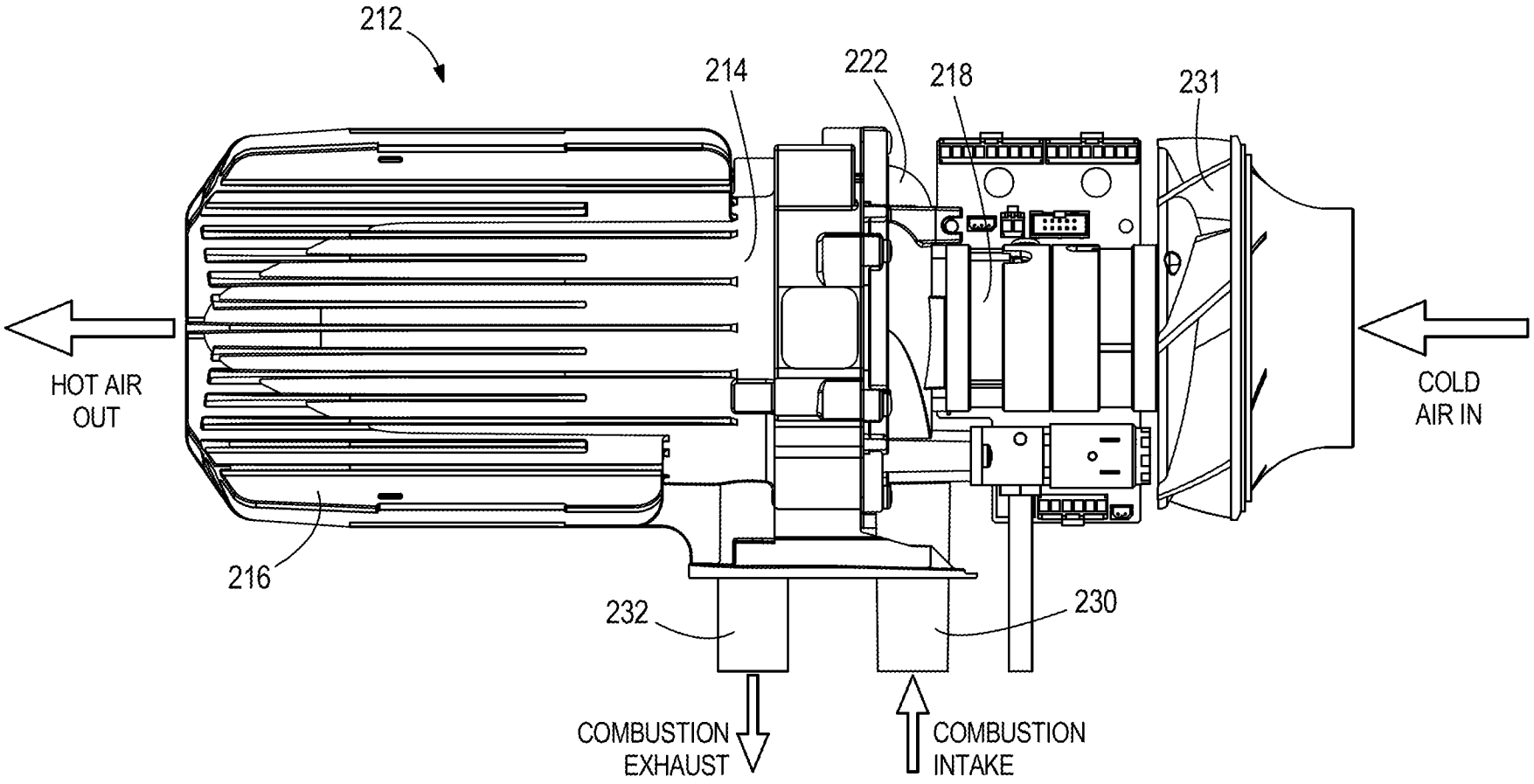
FIG. 11 is an exploded view of the example shown in FIG. 9, illustrating air flow through and across the heat exchanger.

Referring to FIG. 11, a combustion intake port 230 extends through the housing 224 and leads to the fan 40. A combustion exhaust port 232 also extends through the housing 224 from the interior of the heat exchanger 212. The combustion intake and exhaust ports 230, 232 are configured so that air for combustion in the gas burner 10 is drawn by the variable speed forced-air device (here, the fan) 40 into the gas burner 10. Air having been warmed by the gas burner 10 is discharged to the interior of the heat exchanger 212 and then returned to the combustion exhaust port 232. As shown in FIG. 9, the combustion chamber end cap 222 encloses the variable-speed forced-air device 40 with respect to the heat exchanger 212 and thus separates the flow of combustion air with respect to the air being heated by the heat exchanger 212. The control valve 44 is mounted on the combustion chamber end cap 222.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. A gas burner system comprising:

a gas burner having a conduit into which an air-gas mixture is conducted;

a variable-speed forced-air device that forces air through the conduit;

a control valve that controls a supply of gas for mixture with the air to thereby form the air-gas mixture according to a plurality of discrete power settings;

an electrode configured to ignite the air-gas mixture so as to produce a flame;

wherein the electrode is further configured to measure an actual flame ionization current associated with the flame; and a controller comprising a memory storing a minimum speed of the variable-speed forced-air device for each of the plurality of discrete power settings and a target flame ionization current for each of the plurality of discrete power settings, wherein for each discrete power setting the combination of minimum speed and target flame ionization current avoids a flame harmonic mode of the gas burner system, wherein the controller is configured to actively control the variable-speed forced-air device based on a comparison of the actual flame ionization current measured by the electrode with the target flame ionization current of the selected discrete power setting so as to automatically avoid a flame harmonic mode of the gas burner.

2. The gas burner system according to claim 1, wherein the gas burner system is a fully premixed gas burner system in which all air introduced into the conduit is introduced via the variable-speed forced-air device.

3. The gas burner system according to claim 1, wherein the control valve comprises a solenoid coil having a closed position preventing flow of gas there through and a wide open position allowing flow of gas there through, and wherein the control valve comprises a pair of outlet ports that discharge the gas, and wherein the solenoid coil is one of a pair of solenoid coils that independently control discharge of the gas via the pair of outlet ports to the gas burner system, and wherein the control valve facilitates four discrete power settings, including off wherein both solenoid coils are fully closed, low wherein one of the solenoid coils is fully closed and the other of the solenoid coils is fully open, medium wherein the one of the solenoid coils is fully open and the other of the solenoid coils is fully closed, and high wherein both of the solenoid coils are fully open, optionally wherein the controller is configured to control the variable-speed forced-air device at a plurality of power settings, each having a minimum fan speed and each power setting providing a discrete setting for heat input by the gas burner system.

4. The gas burner system according to claim 1, wherein the controller is configured to automatically avoid the flame harmonic mode of the gas burner system by controlling a variable-speed combustion blower so that the air-gas mixture maintains a Reynolds number of greater than 1000 and an air-to-fuel equivalence ratio of greater than 1.2.

5. The gas burner system according to claim 1, wherein the gas burner system comprises a plurality of aeration holes through which the air-gas mixture is forced by the variable-speed forced-air device, wherein the gas burner system comprises a flame tube through which the air-gas mixture is conveyed, a burner deck covering the flame tube, wherein the plurality of aeration holes is formed through the burner deck, and a burner skin covering the plurality of aeration holes, and wherein the plurality of holes consists of 33 aeration holes having a diameter of between 1.9 and 2.1 mm, and optionally wherein the plurality of holes consists of a first group of three holes that are spaced equidistant from each other and surrounded by a second group of eleven holes that are spaced equidistant from each other and surrounded by a third group of nineteen holes that are spaced equidistant from each other, and optionally wherein the second and third groups of holes form concentric circles around the first group of holes, and optionally wherein the burner skin comprises a metal woven mat.

6. The gas burner system according to claim 5, further comprising a heat exchanger, wherein the gas burner system is coupled to the heat exchanger so that heat generated by the gas burner system heats the heat exchanger, and optionally further comprising a housing that contains the heat exchanger and gas burner system, wherein the housing comprises an upstream cool air inlet that receives relatively cool air and a downstream warm air outlet that discharges relatively warm air, and a fan that forces air into the upstream air inlet, across the heat exchanger, and out of the downstream air outlet, and optionally further comprising a combustion intake port on the housing through which air for combustion in the gas burner system is drawn by the variable-speed forced-air device and a combustion exhaust port on the housing through which air from the gas burner system is forced by the variable-speed forced air device, and optionally further comprising an end cap on the variable-speed forced-air device, wherein the control valve is mounted on the end cap.

7. The gas burner system according to claim 1, further comprising an indicator device that indicates to an operator if the controller is unable to control the variable-speed forced-air device to achieve a minimum flame strength.

8. A method of operating a gas burner system, the method comprising:

providing a gas burner system having a conduit;

controlling a control valve from a fully closed state to a fully open state to thereby supply a gas to the conduit;

operating a variable-speed forced-air device to force air into the conduit and mix with the gas to form an air-gas mixture according to a plurality of discrete power settings;

operating an electrode to ignite the air-gas mixture to produce a flame and then to measure an actual flame ionization current associated with the flame;

storing a minimum speed of the variable-speed forced-air device for each of the plurality of discrete power settings and a target flame ionization current for each of the plurality of discrete power settings, wherein for each discrete power setting the combination of minimum speed and target flame ionization current has been determined and selected through experimentation during setup of the gas burner system so as to avoid a flame harmonic mode of the gas burner system; and operating a controller configured to actively control the variable-speed forced-air device based on a comparison of the actual flame ionization current with the target flame ionization current of the selected discrete power setting so as to automatically avoid a flame harmonic mode of the gas burner system.

9. The method according to claim 8, wherein the gas burner system is a fully premixed gas burner system in which all air introduced into the gas burner system is via the variable-speed forced-air device.

10. The method according to claim 8, further comprising controlling the variable-speed forced-air device at a plurality of power settings, each having a minimum fan speed, each power setting providing a discrete setting for heat input by the gas burner system.

11. The method according to claim 8, further comprising operating the controller to automatically avoid the flame harmonic mode of the gas burner system by controlling a variable-speed combustion blower so that the air-gas mixture maintains a Reynolds number of greater than 1000 and an air-to-fuel equivalence ratio of greater than 1.2.

12. The method according to claim 8, further comprising indicating via an indicator device when the controller is unable to control the variable-speed forced-air device to achieve a target flame ionization current.

* * * * *